United States Patent [19]

Grunert et al.

[11] Patent Number: 4,553,115

[45] Date of Patent: Nov. 12, 1985

[54] MOLDED CASE CIRCUIT BREAKER WITH SINGLE SOLENOID OPERATOR FOR RECTILINEAR HANDLE MOVEMENT

[75] Inventors: Kurt A. Grunert, Beaver; Walter K. Huffman, Towamencin Township, Montgomery County, both of Pa.

[73] Assignee: Westinghouse Electric Corp., Pittsburgh, Pa.

[21] Appl. No.: 569,054

[22] Filed: Jan. 9, 1984

[51] Int. Cl.[4] ..... H01H 75/00

[52] U.S. Cl. ..... 335/14; 335/13; 335/171

[58] Field of Search ..... 335/13, 14, 23, 119, 335/120, 131, 170, 171, 173

[56] References Cited

U.S. PATENT DOCUMENTS 4,167,716 9/1979 Horn ..... 335/14

*Primary Examiner*—John C. Martin

*Assistant Examiner*—George Andrews

*Attorney, Agent, or Firm*—M. S. Yatsko

[57] ABSTRACT

A molded case circuit breaker includes a single coil solenoid operator for placing the handle of the circuit breaker in its ON position or in its OFF position. The solenoid operator includes a single coil solenoid formed by an electromagnet secured to a movable electromagnet drive plate and by an armature secured to a movable armature drive plate. The drive plates are disposed for rectilinear movement and are configured alternately to engage a formed trigger plate secured to the handle to move the trigger plate and the handle between the ON position and the OFF position of the handle. A pair of pivotable, bistable mechanical latches are configured to engage and stop further movement of alternate drive plates depending upon the state of the latches. Successive actuations of the single coil solenoid operator cause the handle to be placed alternately in its ON position or in its OFF position.

11 Claims, 21 Drawing Figures

32
34
30
176
182
329
174
82
256
172
178
180
184
188
192
194
200
250
252
254
186
216
218
317
320
318
322
324
326
328
86
224
148
157
228
170
210
212
234
236
96
150
166
214
232
144
146
222
260

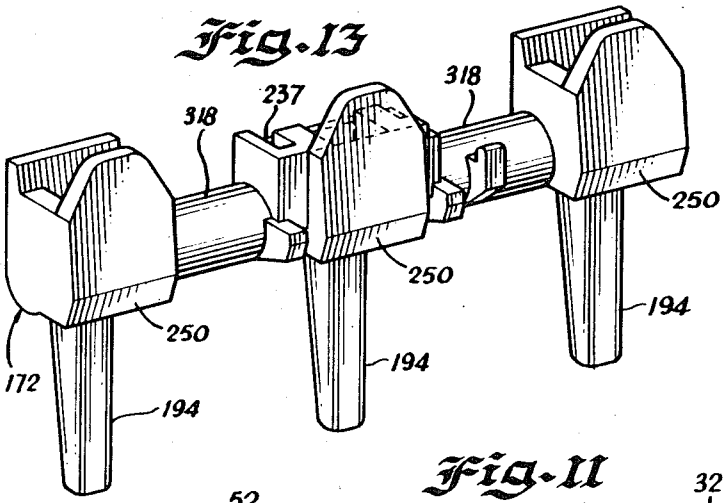
Fig. 13
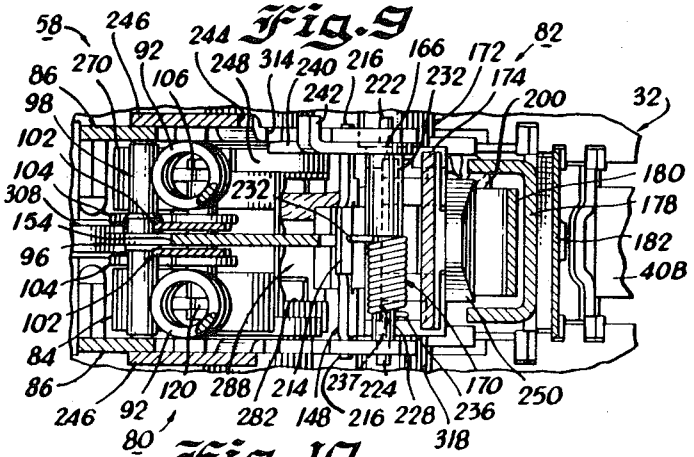
Fig. 9
Fig. 10
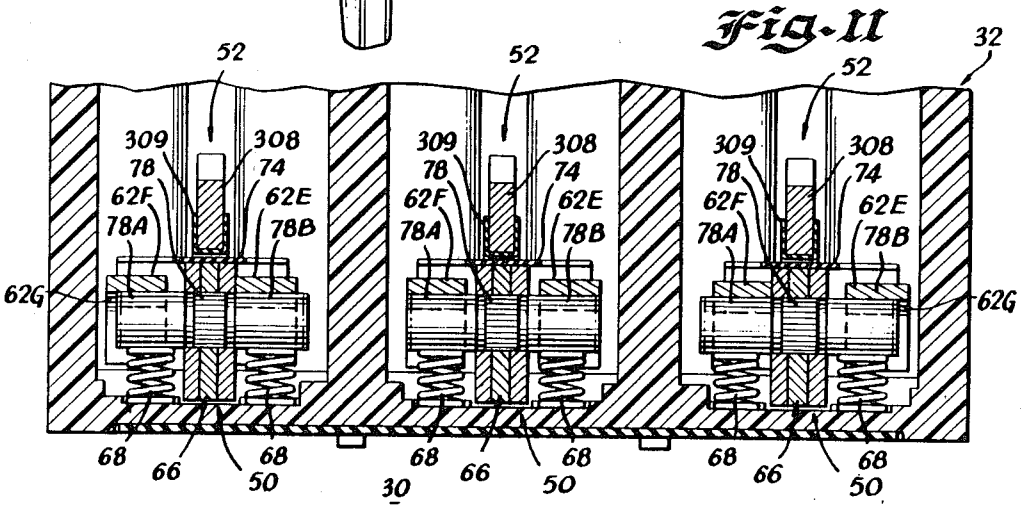
Fig. 11

MOLDED CASE CIRCUIT BREAKER WITH SINGLE SOLENOID OPERATOR FOR RECTILINEAR HANDLE MOVEMENT

CROSS REFERENCE TO RELATED APPLICATIONS

The invention disclosed herein relates to molded case circuit breakers. The inventions disclosed in the following four commonly assigned U.S. patent applications also relate to molded case circuit breakers: U.S. Pat. applications Ser. Nos. 440,680; 440,681; 440,682; and 440,683, all of which were filed on Nov. 10, 1982. In addition, commonly assigned U.S. Pat. application Ser. No. 450,857 filed on Dec. 17, 1982 also relates to molded case circuit breakers.

The following six commonly assigned U.S. patent applications were all filed in the U.S. Patent and Trademark Office on Dec. 19, 1983 and relate to molded case circuit breakers: Ser. No. 562,647, filed by Alfred E. Maier and entitled Molded Case Circuit Breaker With An Apertured Molded Cross Bar For Supporting A Movable Electrical Contract Arm Ser. No. 562,648 filed by Robert H. Flick and Walter K. Huffman and entitled Molded Case Circuit Breaker With Movable Upper Electrical Contact Positioned By Tension Springs; Ser. No. 562,643 filed by Robert H. Flick and Walter K. Huffman and entitled Molded Case Circuit Breaker With Improved Operating Mechanism; Ser. No. 562,644 filed by Alfred A. Maier and entitled Molded Case Circuit Breaker With Adjustable Stationary Lower Electrical Contact Ser. No. 562,602 filed by Robert H. Flick and Walter K. Huffman and entitled Molded Case Circuit Breaker With Movable Lower Electrical Contact and Ser. No. 562,603 filed by Robert H. Flick and Walter K. Huffman and entitled Molded Case Circuit Breaker With Movable Upper Electrical Contact Positioned By Torsion Springs.

Finally, the following five commonly assigned U.S. patent applications were filed in the U.S. Patent and Trademark Office on Jan 3, 1984 the same day as this patent application and relate to molded case circuit breakers: Ser. No. 569,059 filed by Alfred E. Maier and entitled Molded Case Circuit Breaker With Cross Bar Stop Molded In Base Of Case Ser. No. 569,058 filed by Dante Bagalini and entitled Molded Case Circuit Breaker With Resettable Combined Undervoltage And Manual Trip Mechanism Ser. No. filed by Robert H. Flick and Lawrence D. Dennis and entitled Molded Case Circuit Breaker With Adjacent Pole Mechanisms Spaced Closer Than Adjacent Terminals Ser. No. 569,056 filed by Kurt A. Grunert and Joseph F. Changle and entitled Molded Case Circuit Breaker With Handle Lock and Ser. No. 569,055 filed by Joseph J. Matsko, Kurt A. Grunert and Bruce R. Ternorst and entitled Solenoid Operator Circuit For Molded Case Circuit Breaker.

BACKGROUND OF THE INVENTION

A. Field of the Invention

The device of the present invention generally relates to molded case circuit breakers and, more particularly, to solenoid operators for changing the operational condition of the circuit breakers.

B. Description of the Prior Art

Circuit breakers and, more particularly molded case circuit breakers are old and well known in the prior art. Examples of such devices are disclosed in U.S. Pat. Nos.

2,186,251; 2,492,009; 3,239,638; 3,525,959; 3,590,325; 3,614,685; 3,775,713; 3,783,423; 3,805,199; 3,815,059; 3,863,042; 3,959,695; 4,077,025; 4,166,205; 4,258,403; and 4,295,025. In general, prior art molded case circuit breakers have been provided with movable contact arrangements and operating mechanisms designed to provide protection for an electrical circuit or system against electrical faults, specifically, electrical overload conditions, low level short circuit or fault current conditions, and, in some cases, high level short circuit or fault current conditions. Prior art devices have utilized an operating mechanism having trip mechanism for controlling the movement of an over-center toggle mechanism to separate a pair of electrical contacts upon an overload condition or upon a short circuit or fault current condition. Such trip mechanisms have included a bimetal movable in response to an overload condition to rotate a trip bar, resulting in the movement of the over-center toggle mechanism to open a pair of electrical circuit breaker contacts. Such prior art devices have also utilized an armature movable in response to the flow of short circuit or fault current to similarly rotate the trip bar to cause the pair of contacts to separate. At least some prior art devices use blow-apart contacts to rapidly interrupt the flow of high level short circuit or fault currents. The operating mechanisms of many prior art devices include rotatable cross bars for moving upper electrical contacts into and out of engagement with lower electrical contacts in each pole or phase of the circuit breakers. The operating mechanisms of typical prior art devices also include externally extending manually engageable handles for actuating the rotable cross bars to move the upper electrical contacts into and out of engagement with the lower electrical contacts. Many prior art devices also utilize an electromechnical or solenoid actuated operator for moving the handle from a remote location between its ON position and its OFF position.

While many prior art devices have provided adequate protection against fault conditions in an electrical circuit, a need exists for dimensionally small molded case circuit breakers capable of fast, effective and reliable operation and, more specifically, for a single coil solenoid operator for inexpensively, effectively and reliably achieving rectilinear movement of a manually engageable handle of a circuit breaker.

SUMMARY OF THE INVENTION

An object of the present invention is to provide a new and improved circuit breaker.

Another object of the present invention is to provide a new and improved molded case circuit breaker having a single coil solenoid operator for achieving rectilinear movement of a manually engageable handle of the circuit breaker.

Briefly, the present invention relates to a molded case circuit breaker having a single coil solenoid operator for achieving rectilinear or bidirectional linear movement of a manually engageable handle of the circuit breaker for placing the handle alternately in its ON position or in its OFF position. The solenoid operator includes a single coil solenoid formed by an electromagnet and an armature movable within the electromagnet. The electromagnet and the armature are respectively secured to spaced apart drive plates that are disposed for rectilinear movement along the longitudinal axis of an opening through the case of the circuit breaker through which the handle extends. A mounting plate disposed above the handle is provided for controlling the movement of the drive plates and for mounting a pair of pivotable, bistable mechanical latches configured to alternately engage and stop further movement of one of the drive plates. Each drive plate includes a drive surface extending through and movable along an elongated operating slot formed through the mounting plate and is configured to engage a drive surface of a formed trigger plate secured to the handle.

Each of the bistable latches includes an elongated tension spring secured thereto, an electromagnet drive plate stop, an armature drive plate stop and a pivot center about which the bistable latch is pivotable. The trigger plate includes a pair of tapered latch engaging portions that are engageable with the tension springs of the bistable latches and are capable of rapidly pivoting the bistable latches between two stable states or positions, an electromagnet drive plate engaging state or position and an armature drive plate engaging state or position.

Upon the actuation of the single coil solenoid, if the handle is in its OFF position, the electromagnet drive plate is rapidly moved into engagement with the electromagnet drive plate stops of the bistable latches; and the armature drive plate moves the trigger plate and the handle in unison along the elongated operating slot until the operating springs of the operating mechanism of the circuit breaker change their lines of action to accelerate the handle and the trigger plate to the ON position of the handle. As the latch engaging portions of the trigger plate pass the pivot centers of the bistable latches, the latches quickly pivot into their armature drive plate stop state or position to stop or limit the movement of the armature drive plate.

A subsequent energization of the solenoid is effective to move the handle from its ON position to its OFF position. Specifically, the electromagnet drive plate drives the trigger plate and the handle in the direction of the armature drive plate. When the handle is moved sufficiently along the elongated operating slots, the operating springs of the operating mechanism of the circuit breaker change their lines of action to accelerate the handle and the trigger plate to the OFF position of the handle. When the latch engaging portions of the trigger plate pass the pivot centers of the bistable latches, the latches rapidly pivot into their electromagnet drive plate stop state or position to stop or limit movement of the electromagnet drive plate. In this manner, rectilinear or bidirectional linear movement of the handle of the circuit breaker may be achieved from a remote location by a single coil solenoid operator.

BRIEF DESCRIPTION OF THE DRAWING

The above and other objects and advantages and novel features of the present invention will become aparent from the following detailed description of the preferred and alternative embodiments of a molded case circuit breaker illustrated in the accompanying drawing wherein:

FIG. 9 is an enlarged, fragmentary, plan view of the center pole or phase of the device of FIG. 1 taken along line 9—9 of FIG. 3;

FIG. 10 is an enlarged, fragmentary, plan view of the center pole or phase of the device of FIG. 1 taken along line 10—10 of FIG. 3;

FIG. 11 is an enlarged, fragmentary cross sectional view of a portion of the device of FIG. 1 taken along line 11—11 of FIG. 3

FIG. 13 is an enlarged, perspective view of the trip bar of the device of FIG. 1;

DESCRIPTION OF THE PREFERRED EMBODIMENT

Figure 1:
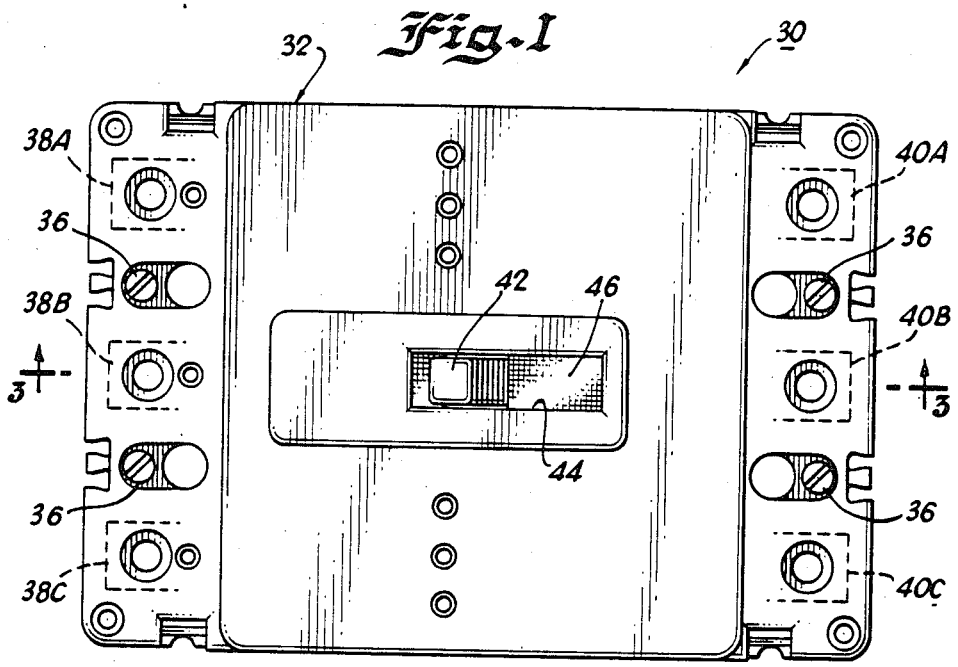
FIG. 1 is a top plan view of a molded case circuit breaker.
Figure 2:
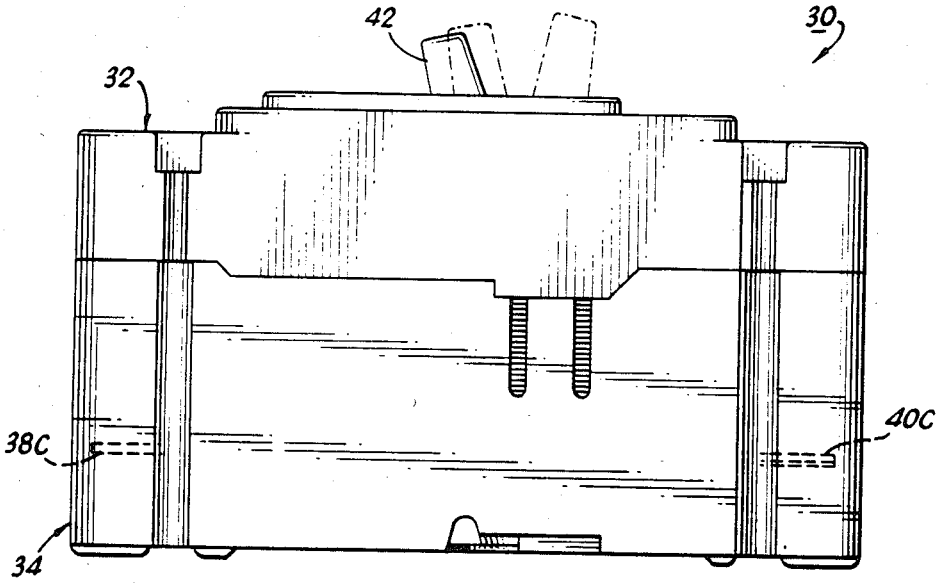
FIG. 2 is a side elevational view of the device of FIG. 1.

Referring to the drawing and initially to FIGS. 1–15, there is illustrated a new and improved molded case circuit breaker 30 constructed in accordance with the principles of the present invention. While the circuit breaker 30 is depicted and described herein as a three phase or three pole circuit breaker, the principles of the present invention disclosed herein are equally applicable to single phase or other polyphase circuit breakers and to both AC circuit breakers and DC circuit breakers.

The circuit breaker 30 includes a molded, electrically insulating, top cover 32 mechanically secured to a molded, electrically insulating, bottom cover or base 34 by a plurality of fasteners 36. A plurality of first electrical terminals or line terminals 38A, 38B and 38C (FIG.

4) are provided, one for each pole or phase, as are a plurality of second electrical terminals or load terminals 40A, 40B and 40C. These terminals are used to serially electrically connect the circuit breaker 30 into a three phase electrical circuit for protecting a three phase electrical system.

Figure 15:
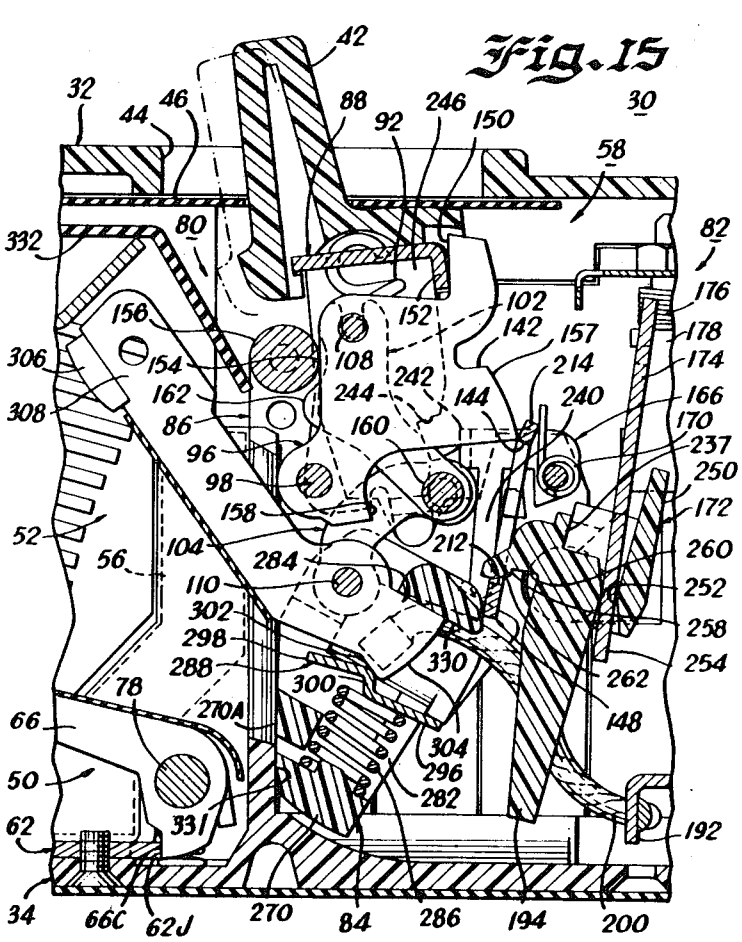
FIG. 15 is an enlarged, fragmentary, cross sectional view of the center pole or phase of the device of FIG. 1, depicting the devive in its TRIPPED position.
Figure 14:
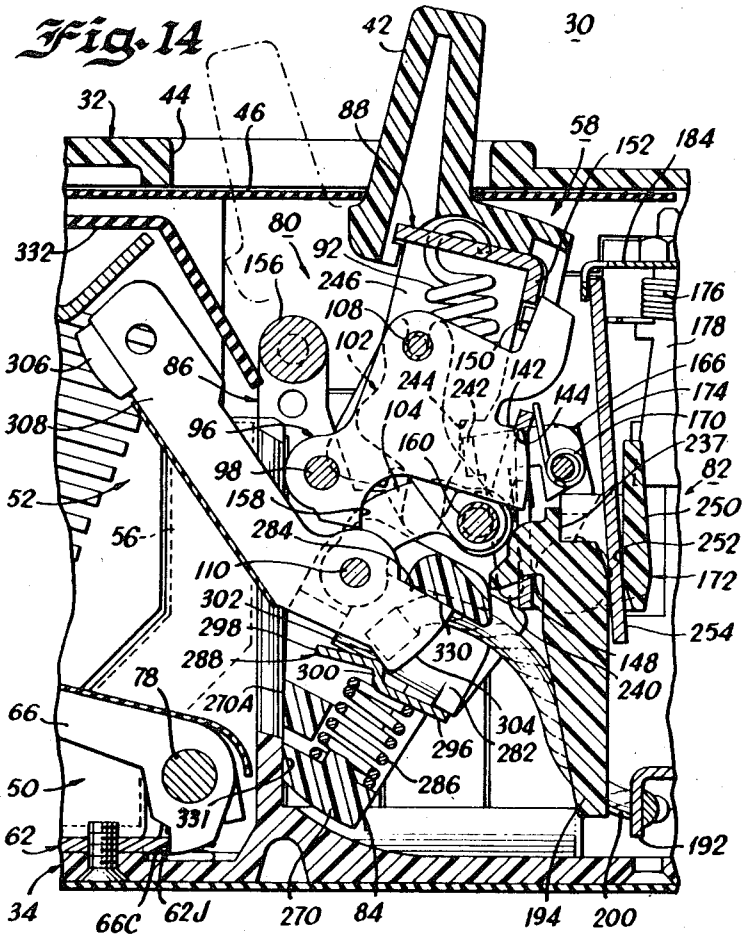
FIG. 14 is an enlarged, fragmentary, cross sectional view of the center pole or phase of the device of FIG. 1, depicting the device in its OPEN position.

The circuit breaker 30 further includes an electrically insulating, rigid, manually engageable handle 42 extending through an opening 44 in the top cover 32 for setting the circuit breaker 30 to its CLOSED position (FIG. 3) or to its OPEN position (FIG. 14). The circuit breaker 30 also may assume a BLOWN-OPEN position (FIG. 3, dotted line position) or a TRIPPED position (FIG. 15). Subsequently to being placed in its TRIPPED position, the circuit breaker 30 may be reset for further protective operation by moving the handle 42 from its TRIPPED position (FIG. 15) past its OPEN position (FIG. 14). The handle 42 may then be left in its OPEN position (FIG. 14) or moved to its CLOSED position (FIG. 3), in which case the circuit breaker 30 is ready for further protective operation. The movement of the handle 42 may be achieved either manually or automatically by a machine actuator. Preferably, an electrically insulating strip 46, movable with the handle 42, covers the bottom of the opening 44 and serves as an electrical barrier between the interior and the exterior of the circuit breaker 30.

As its major internal components, the circuit breaker 30 includes a lower electrical contact 50, an upper electrical contact 52, an electrical arc chute 54, a slot motor 56, and an operating mechanism 58. The arc chute 54 and the slot motor 56 are conventional, per se, and thus are not discussed in detail hereinafter. Briefly, the arc chute 54 is used to divide a single electrical arc formed between separating electrical contacts 50 and 52 upon a fault condition into a series of electrical arcs, increasing the total arc voltage and resulting in a limiting of the magnitude of the fault current. The slot motor 56, consisting either of a series of generally U-shaped steel liminations encased in electrical insulation or of a generally U-shaped, electrically insulated, solid steel bar, is disposed about the contacts 50 and 52 to concentrate the magnetic field generated upon a high level short circuit or fault current condition, thereby greatly increasing the magnetic repulsion forces between the separating electrical contacts 50 and 52 to rapidly accelerate the separation of electrical contacts 50 and 52. The rapid separation of the electrical contacts 50 and 52 results in a relatively high arc resistance to limit the magnitude of the fault current. Reference may be had to U.S. Pat. No. 3,815,059 for a more detailed description of the arc chute 54 and the slot motor 56.

The lower electrical contact 50 (FIGS. 3, 4 and 11) includes a lower, formed, stationary member 62 secured to the base 34 by a fastener 64, a lower movable contact arm 66, a pair of electrical contact compression springs 68, a lower contact biasing means or compression spring 70, a contact 72 for physically and electrically contacting the upper electrical contact 52 and an electrically insulating strip 74 to reduce the possibility of arcing between the upper electrical contact 52 and portions of the lower electrical contact 50. The line terminal 38B extending exteriorly of the base 34 comprises an integral end portion of the member 62. The member 62 includes an inclined portion 62A that serves as a lower limit or stop for the moving contact arm 66 during its blow-open operation; an aperture 62B overlying a recess 76 formed in the base 34 for seating the compression spring 70; and a lower flat section 62C through which the aperture 62B is formed. The flat section 62C may also include a threaded aperture 62D formed therethrough for receiving the fastener 64 to secure the stationary member 62 and thus the lower electrical contact 50 to the base 34. The stationary member 62 includes a pair of spaced apart, integrally formed, upstanding, generally curved or U-shaped contacting portions 62E and 62F. The contacting portions 62E and 62F each include two, spaced apart, flat, inclined surfaces 62G and 62H, inclined at an angle of approximately 45 degrees to the plane of the lower flat section 62C and extending laterally across the inner surfaces of the contacting portions 62E and 62F. A stop 62J (FIG. 4) is provided for limiting the upward movement of the contact arm 66.

The contact arm 66 is fixedly secured to a rotatable pin 78 (FIG. 11) for rotation therewith within the curved contacting portions 62E and 62F about the longitudinal axis of the rotatable pin 78. The rotatable pin 78 includes outwardly extending round contacting portions 78A and 78B that are biased by the compression springs 68 into effective current conducting contact with the surfaces 62G and 62H of the portions 62F and 62E, respectively. In this manner, effective conductive contact and current transfer is achieved between the lower formed stationary member 62 and the lower movable contact arm 66 through the rotatable pin 78. The lower movable contact arm 66 includes an elongated rigid lever arm 66A extending between the rotatable pin 78 and the contact 72 and a downwardly protuberant portion or spring locator 66B receipt within the upper end of the compression spring 70 for maintaining effective contact between the lower movable arm 66 and the compression spring 70. Finally, the lower movable contact arm 66 includes an integrally formed, flat surface 66C formed at its lower end for contacting the stop 62J to limit the upward movement of the lower movable contact arm 66 and the contact 72 fixedly secured thereto.

Figure 3:
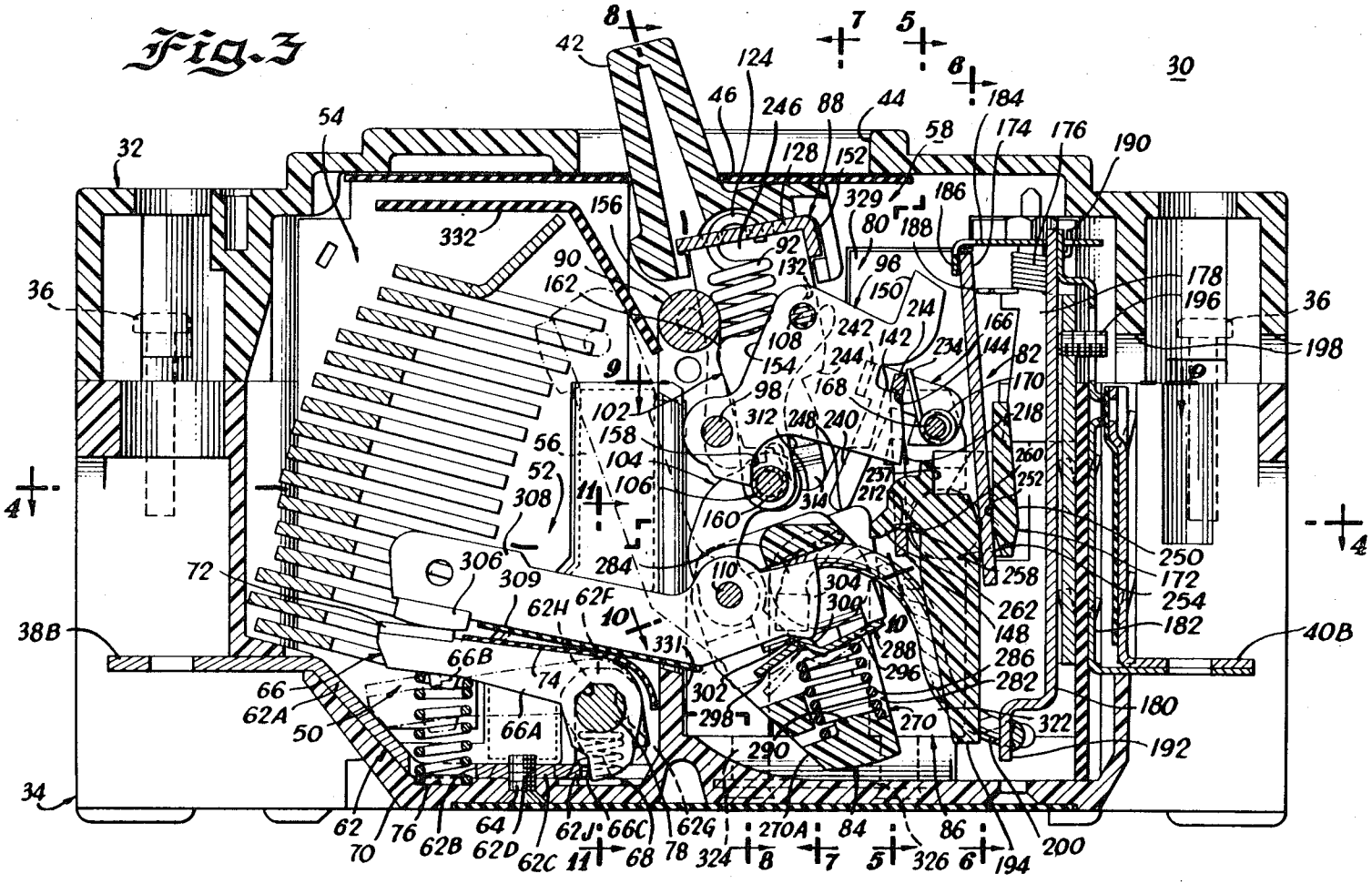
FIG. 3 is an enlarged, cross sectional view of the device of FIG. 1 taken along line 3—3 of FIG. 1, depicting the device in its CLOSED and BLOWN-OPEN positions.
Figure 4:
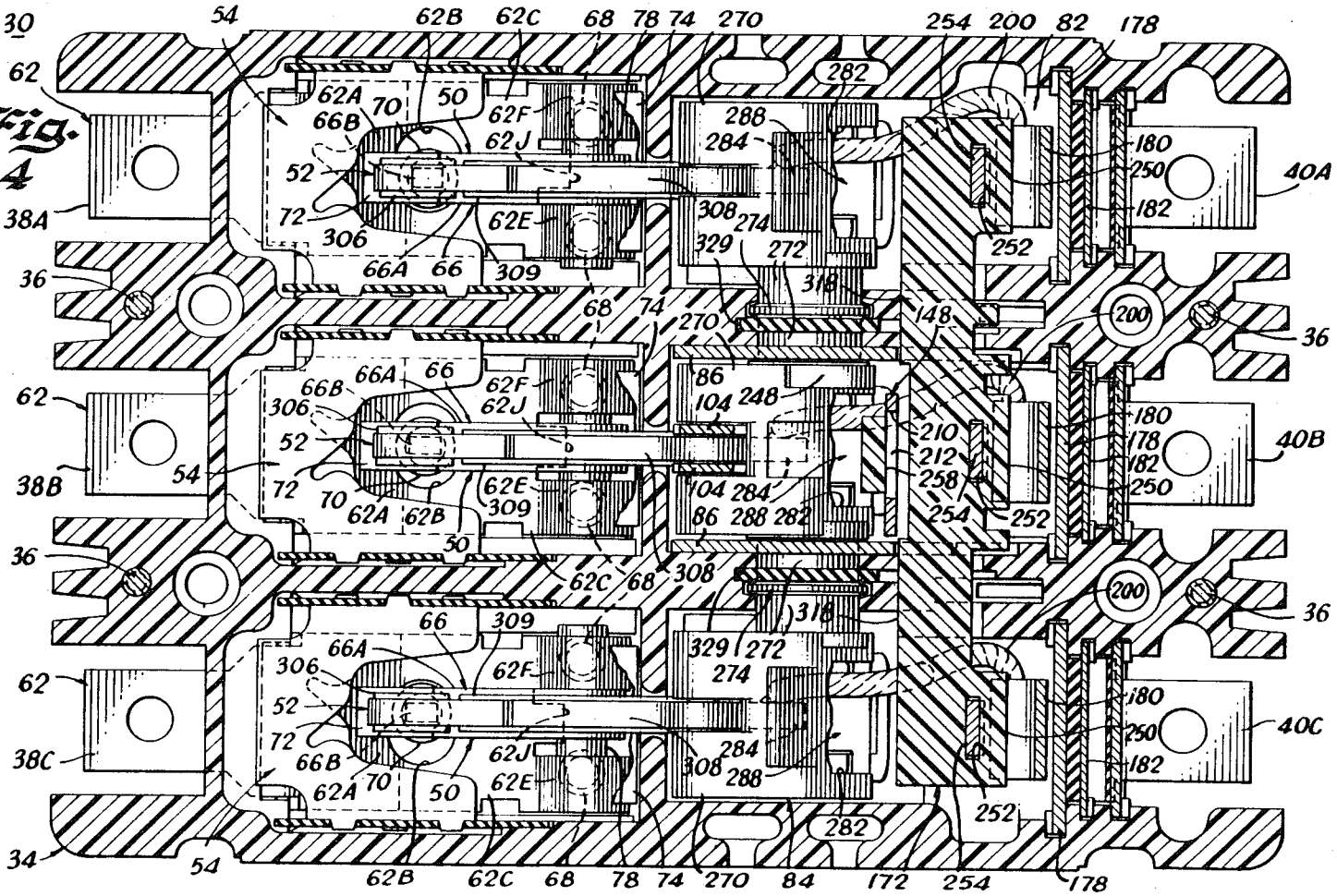
FIG. 4 is an enlarged, plan sectional view of the device of FIG. 1 taken along line 4—4 of FIG. 3.

The lower electrical contact 50 as described hereinabove utilizes the high magnetic repulsion forces generated by high level short circuit or fault current flowing through the elongated parallel portions of the electrical contacts 50 and 52 to cause the rapid downward movement of the contact arm 66 against the bias of the compression spring 70 (FIG. 3). An extremely rapid separation of the electrical contacts 50 and 52 and a resultant rapid increase in the resistance across the electrical arc formed between the electrical contacts 50 and 52 is thereby achieved, providing effective fault current limitation within the confines of relatively small physical dimensions. The lower electrical contact 50 further eliminates the necessity for utilizing a flexible copper shunts used in many prior art molded case circuit breakers for providing a current carrying conductive path between a terminal of the circuit breaker and a lower movable contact arm of a lower electrical contact. The use of the compression springs 68 to provide a constant bias against the pin 78 provides an effective current path between the terminal 38B and the contact 72 while enabling the mounting of the lower electrical contact 50 in a small, compact area.

The operating mechanism 58 includes an over-center toggle mechanism 80; a trip mechanism 82; an integral or one-piece molded cross bar 84 (FIG. 12); a pair of rigid, opposed or spaced apart, metal side plates 86; a rigid, pivotable, metal handle yoke 88; a rigid stop pin 90; and a pair of operating tension springs 92.

The over-center toggle mechanism 80 includes a rigid, metal cradle 96 that is rotatable about the longitudinal central axis of a cradle support pin 98. The opposite longitudinal ends of the cradle support pin 98 in an assembled condition are retained in a pair of apertures 100 formed through the side plates 86.

The toggle mechanism 80 further includes a pair of upper toggle links 102, a pair of lower toggle links 104, a toggle spring pin 106 and an upper toggle link follower pin 108. The lower toggle links 104 are secured to the upper electrical contact 52 by a toggle contact pin 110. Each of the lower toggle links 104 includes a lower aperture 112 for receipt therethrough of the toggle contact pin 110. The toggle contact pin 110 also passes through an aperture 114 formed through the upper electrical contact 52 enabling the upper electrical contact 52 to freely rotate about the central longitudinal axis of the pin 110. The opposite longitudinal ends of the pin 110 are received and retained in the cross bar 84. Thus, movement of the upper electrical contact 52 under other than high level short circuit or fault current conditions and the corresponding movement of the cross bar 84 is effected by movement of the lower toggle links 104. In this manner, movement of the upper electrical contact 52 by the operating mechanism 58 in the center pole or phase of the circuit breaker 30 simultaneously, through the rigid cross bar 84, causes the same movement in the upper electrical contacts 52 associated with the other poles or phases of the circuit breaker 30.

Each of the lower toggle links 104 also includes an upper aperture 116; and each of the upper toggle links 102 includes an aperture 118. The pin 106 is received through the apertures 116 and 118, thereby interconnecting the upper and lower toggle links 102 and 104 and allowing rotational movement therebetween. The opposite longitudinal ends of the pin 106 include journals 120 for the receipt and retention of the lower, hooked or curved ends 122 of the springs 92. The upper, hooked or curved ends 124 of the springs 92 are received through and retained in slots 126 formed through an upper, planar or flat surface 128 of the handle yoke 88. At least one of the slots 126 associated with each spring 92 includes a locating recess 130 for positioning the curved ends 124 of the springs 92 to minimize or prevent substantial lateral movement of the springs 92 along the lengths of the slots 126.

In an assembled condition, the disposition of the curved ends 124 within the slots 126 and the disposition of the curved ends 122 in the journals 120 retain the links 102 and 104 in engagement with the pin 106 and also maintain the springs 92 under tension, enabling the operation of the over-center toggle mechanism 80 to be controlled by and responsive to external movements of the handle 42.

The upper links 102 also include recesses or grooves 132 for receipt in and retention by a pair of spaced apart journals 134 formed along the length of the pin 108. The center portion of the pin 108 is configured to be received in an aperture 136 formed through the cradle 96 at a location spaced by a predetermined distance from the axis of rotation of the cradle 96. Spring tension from the springs 92 retains the pin 108 in engagement with the upper toggle links 102. Thus, rotational movement of the cradle 96 effects a corresponding movement or displacement of the upper portions of the links 102.

The cradle 96 includes a slot or groove 140 having an inclined flat latch surface 142 formed therein. The surface 142 is configured to engage an inclined flat cradle latch surface 144 formed at the upper end of an elongated slot or aperture 146 formed through a generally flat, intermediate latch plate 148. The cradle 96 also includes a generally flat handle yoke contacting surface 150 configured to contact a downwardly depending elongated surface 152 formed along one edge of the upper surface 128 of the handle yoke 88. The operating springs 92 move the handle 42 during a trip operation; and the surfaces 150 and 152 locate the handle 42 in a TRIPPED position (FIG. 15), intermediate the CLOSED position (FIG. 3) and the OPEN position (FIG. 14) of the handle 42, to indicate that the circuit breaker 30 has tripped. In addition, the engagement of the surfaces 150 and 152 resets the operating mechanism 58 subsequent to a trip operation by moving the cradle 96 in a clockwise direction against the bias of the operating springs 92 from its TRIPPED position (FIG. 15) to and past its OPEN position (FIG. 14) to enable the relatching of the surface 142 and 144.

The cradle 96 further includes a generally flat elongated stop surface 154 for contacting a peripherally disposed, radially outwardly protuberant portion or rigid stop 156 formed about the center of the stop pin 90. The engagement of the surface 154 with the rigid stop 156 limits the movement of the cradle 96 in a counterclockwise direction subsequent to a trip operation (FIG. 15). The cradle 96 also includes a curved, intermediate latch plate follower surface 157 for maintaining contact with the outermost edge of the inclined latch surface 144 of the intermediate latch plate 148 upon the disengagement of the latch surfaces 142 and 144 during a trip operation (FIG. 15). An impelling surface of kicker 158 is also provided on the cradle 96 for engaging a radially outwardly projecting portion or contacting surface 160 formed on the pin 106 upon the release of the cradle 96 to immediately and rapidly propel the pin 106 in a counterclockwise arc from an OPEN position (FIG. 3) to a TRIPPED position (FIG. 15), thereby rapidly raising and separating the upper electrical contact 52 from the lower electrical contact 50.

During such a trip operation, an enlarged portion or projection 162 formed on the upper toggle links 102 is designed to contact the stop 156 with a considerable amount of force provided by the operating springs 92 through the rotating cradle 96, thereby accelerating the arcuate movements of the upper toggle links 102, the toggle spring pin 106 and the lower toggle links 104. In this manner, the speed of operation or the response time of the operating mechanism 58 is significantly increased.

The trip mechanism 82 includes the intermediate latch plate 148, a movable or pivotable handle yoke latch 166, a torsion spring spacer pin 168, a double acting torsion spring 170, a molded, integral or one-piece trip bar 172 (FIG. 13), an armature 174, an armature torsion spring 176, a magnet 178, a biametal 180 and a conductive member or heater 182. The bimetal 180 is electrically connected to the terminal 40B through the conductive member 182. The magnet 178 physically surrounds the bimetal 180 thereby establishing a magnetic circuit to provide a response to short circuit or fault current conditions. An armature stop plate 184 has a downwardly depending edge portion 186 that engages the upper end of the armature 174 to limit its movement in the counterclockwise direction. The torsion spring 176 has one longitudinal end formed as an elongated spring arm 188 for biasing the upper portion of the armature 174 against movement in a clockwise direction. An opposite, upwardly disposed, longitudinal end 190 of the torsion spring 176 is disposed in one of a plurality of spaced apart apertures (not illustrated) formed through the upper surface of the plate 184. The spring tension of the spring arm 188 may be adjusted by positioning the end 190 of the torsion spring 176 in a different one of the apertures formed through the upper surface of the support plate 184.

The bimetal 180 includes a formed lower end 192 spaced by a predetermined distance from the lower end of a downwardly depending contact leg 194 of the trip bar 172 (FIG. 3). The spacing between the end 192 and the leg 194 when the circuit breaker 30 is in a CLOSED position (FIG. 3) may be adjusted to change the response time of the circuit breaker 30 to overload conditions by appropriately turning a set screw 196, access to which may be provided by apertures 198 formed through the top cover 32. A current carrying conductive path between the lower end 192 of the bimetal 180 and the upper electrical contact 52 is achieved by a flexible copper shunt 200 connected by any suitable means, for example, by brazing, to the lower end 192 of the bimetal 180 and to the upper electrical contact 52 within the cross bar 84. In this manner, an electrical path is provided through the circuit breaker 30 between the terminals 38B and 40B via the lower electrical contact 50, the upper electrical contact 52, the flexible shunt 200, the bimetal 180 and the conductive member 182.

In addition to the cradle latch surface 144 formed at the upper end of the elongated slot 146, the intermediate latch plate 148 includes a generally square shaped aperture 210, a trip bar latch surface 212 at the lower portion of the aperture 210, an upper inclined flat portion 214 and a pair of oppositely disposed laterally extending pivot arms 216 configured to be received within inverted keystones or apertures 218 formed through the side plates 86. The configuration of the apertures 218 is designed to limit the pivotable movement of the pivot arms 216 and thus of the intermediate latch plate 148.

The handle yoke latch 166 includes an aperture 220 for receipt therethrough of one longitudinal end 222 of the pin 168. The handle yoke latch 166 is thus movable or pivotable about the longitudinal axis of the pin 168. An opposite longitudinal end 224 of the pin 168 and the end 222 are designed to be retained in a pair of spaced apart apertures 226 formed through the side plates 86. Prior to the receipt of the end 224 in the aperture 226, the pin 168 is passed through the torsion spring 170 to mount the torsion spring 170 about an intermediately disposed raised portion 228 of the pin 168. One longitudinal end of the body of the torsion spring 170 is received against an edge 230 of a raised portion 232 of the pin 168 to retain the torsion spring 170 in a proper operating position. The torsion spring 170 includes an elongated, upwardly extending spring arm 234 for biasing the flat portion 214 of the intermediate latch plate 148 for movement in a counterclockwise direction for resetting the intermediate latch plate 148 subsequently to a trip operation by the overcenter toggle mechanism 80 and a downwardly extending spring arm 236 for biasing an upper portion or surface 237 of the trip bar 172 against rotational movement in a clockwise direction (FIG. 3).

The handle yoke latch 166 includes an elongated downwardly extending latch leg 240 and a bent or outwardly extending handle yoke contacting portion 242 (FIGS. 9 and 12) that is physically disposed to be received in a slotted portion 244 formed in and along the length of one of a pair of downwardly depending support arms 246 of the handle yoke 88 during a reset operation (FIG. 14). The engagement of the aforementioned downwardly depending support arm 246 by the handle yoke latch 166 prohibits the handle yoke 88 from traveling to its reset position if the contacts 72 and 306 are welded together. If the contacts 72 and 306 are not welded together, the crossbar 84 rotates to its TRIPPED position (FIG. 15); and the handle yoke latch 166 rotates out of the path of movement of the downwardly depending support arm 246 of the handle yoke 88 and into the slotted portion 244 to enable the handle yoke 88 to travel to its reset position, past its OPEN position (FIG. 14). An integrally molded outwardly projecting surface 248 on the cross bar 84 is designed to engage and move the latch leg 240 of the handle yoke latch 166 out of engagement with the handle yoke 88 during the movement of the cross bar 84 from its OPEN position (FIG. 14) to its CLOSED position (FIG. 3).

Preferably, the trip bar 172 is formed as a molded, integral or one-piece trip bar 172 having three, spaced apart downwardly depending contact legs 194, one such contact leg 194 being associated with each pole or phase of the circuit breaker 30. In addition, the trip bar 172 includes three, enlarged armature support sections 250, one such support section 250 for each pole or phase of the circuit breaker 30. Each of the support sections 250 includes an elongated, generally rectangularly shaped slot or pocket 252 formed therethrough (FIGS. 6 and 9) for receiving a downwardly depending trip leg 254 of the armature 174. The armature 174 includes outwardly extending edges or shoulder portions 256 for engaging the upper surfaces of the pockets 252 to properly seat the armature 174 in the trip bar 172. Each trip leg 254 is designed to engage and rotate an associated contact leg 194 of the trip bar 172 in a clockwise direction (FIG. 15) upon the occurrence of a short circuit or fault current condition.

The trip bar 172 also includes a latch surface 258 (FIG. 3) for engaging and latching the trip bar latch surface 212 of the intermediate latch plate 148. The latch surface 258 is disposed between a generally horizontally disposed surface 260 and a separate, inclined surface 262 of the trip bar 172. The latch surface 258 (FIG. 3) is a vertically extending surface having a length determined by the desired response characteristics of the operating mechanism 58 to an overload condition or to a short circuit or fault current condition. In a specific embodiment of the present invention, an upward movement of the surface 260 of approximately one-half millimeter is sufficient to unlatch the surfaces 258 and 212. Such unlatching results in movement between the cradle 96 and the intermediate latch plate 148 along the surfaces 142 and 144, immediately unlatching the cradle 96 from the intermediate latch plate 148 and enabling the counterclockwise rotational movement of the cradle 96 and a trip operation of the circuit breaker 30. During a reset operation, the spring arm 236 of the torsion spring 170 engages the surface 237 of the trip bar 172, causing the surface 237 to rotate counterclockwise to enable the latch surface 258 of the trip bar 172 to engage and relatch with the latch surface 212 of the intermediate latch plate 148 to reset the intermediate latch plate 148, the trip bar 172 and the circuit breaker 30. The length of the curved surface 157 of the cradle 96 should be sufficient to retain contact between the upper portion 214 of the intermediate latch plate 148 and the cradle 96 to prevent resetting of the intermediate latch plate 148 and the trip bar 172 until the latch surface 142 of the cradle 96 is positioned below the latch surface 144 of the intermediate latch plate 148. Preferably, each of the three poles or phases of the circuit breaker 30 is provided with a bimetal 180, an armature 174 and a magnet 178 for displacing an associated contact leg 194 of the trip bar 172 as a result of the occurrence of an overload condition or of a short circuit or fault current condition in any one of the phase to which the circuit breaker 30 is connected.

In addition to the integral projecting surface 248, the cross bar 84 includes three enlarged sections 270 (FIG. 12) separated by round bearing surfaces 272. A pair of peripherally disposed, outwardly projecting locators 274 are provided to retain the cross bar 84 in proper position within the base 36. The base 36 includes bearing surfaces 276 (FIG. 7) complementarily shaped to the bearing surfaces 272 for seating the cross bar 84 for rotational movement in the base 34. The locators 274 are received within arcuate recesses or grooves 278 formed along the surfaces 276. Each enlarged section 270 further includes a pair of spaced apart apertures 280 (FIG. 10) for receiving the toggle contact pin 110. The pin 110 may be retained within the apertures 280 by any suitable means, for example, by an interference fit therebetween.

Each enlarged section 270 also includes a window, pocket or fully enclosed opening 282 formed therein (FIG. 12) for receipt of one longitudinal end or base portion 284 of the upper electrical contact 52 (FIG. 3). The opening 282 also permits the receipt and retention of a contact arm compression spring 286 (FIG. 12) and an associated, formed, spring follower 288. The compression spring 286 is retained in proper position within the enlarged section 270 by being disposed about an integrally formed, upwardly projecting boss 290.

The spring follower 288 is configured to be disposed between the compression spring 286 and the base portion 284 of the upper electrical contact 52 to transfer the compressive force from the spring 286 to the base portion 284, thereby ensuring that the upper electrical contact 52 and the cross bar 84 move in unison. The spring follower 288 includes a pair of spaced apart generally J-shaped grooves 292 formed therein for receipt of a pair of complementarily shaped, elongated ridges or shoulder portions 294 to properly locate and retain the spring follower 288 in the enlarged section 270. A first generally planar portion 296 is located at one end of the spring follower 288; and a second planar portion 298 is located at the other longitudinal end of the spring follower 288 and is spaced from the portion 296 by a generally flat inclined portion 300.

The shape of the spring follower 288 enables it to engage the base portion 284 of the upper electrical contact 52 with sufficient spring force to ensure that the upper electrical contact 52 follows the movement of the cross bar 84 in response to operator movements of the handle 42 or the operation of the operating mechanism 58 during a normal trip operation. However, upon the occurrence of a high level short circuit or fault current condition, the upper electrical contact 52 can rotate about the pin 110 by deflecting the spring follower 288 downwardly (FIG. 3), enabling the electrical contacts 50 and 52 to rapidly separate and move to their BLOWN-OPEN positions (FIG. 3) without waiting for the operating mechanism 58 to sequence. This independent movement of the upper electrical contact 52 under the above high fault condition is possible in any pole or phase of the circuit breaker 30.

During normal operating conditions, an inclined surface 302 of the base portion 284 of the upper electrical contact 52 contacts the inclined portion 300 or the junction between the portions 298 and 300 of the spring follower 288 to retain the cross bar 84 in engagement with the upper electrical contact 52. However, upon the occurrence of a high level short circuit or fault current condition, the inclined surface 302 is moved past and out of engagement with the portions 298 and 300; and a terminal portion or surface 304 of the base portion 284 engages the downwardly deflected planar portion 298 of the spring follower 288 to retain the upper electrical contact 52 in its BLOWN-OPEN position, thereby eliminating or minimizing the possibility of contact restrike. Subsequently, when the circuit breaker 30 trips, the upper electrical contact 52 is forced by the operating mechanism 58 against the stop 156 to reset the upper electrical contact 52 for movement in unison with the cross bar 84. During this resetting operation, the surface 304 is moved out of engagement with the portion 298 and the inclined portion 302 is moved back into engagement with the spring follower 288. By changing the configuration of the spring follower 288 or the configuration of the surfaces 302, of the base portion 284 of the upper electrical contact 52, the amount of upward travel of the upper electrical contact 52 during a BLOWN-OPEN operation required to bring the surface 304 into contact with the spring follower 288 can be altered as desired.

The openings 282 formed in the enlarged sections 270 of the cross bar 84 permit the passage of the flexible shunts 200 therethrough without significantly reducing the strength of the cross bar 84. Since the flexible shunts 200 pass through the openings 282 adjacent the axis or rotation of the cross bar 84, minimum flexing of the flexible shunts 200 occurs, increasing the longevity and reliability of the circuit breaker 30.

The upper electrical contact 52 also includes a contact 306 for physically and electrically contacting the contact 72 of the lower electrical contact 50 and an upper movable elongated contact arm 308 disposed between the contact 306 and the base portion 284. It is the passage of high level short circuit or fault current through the generally parallel contact arms 66 and 308 that causes very high magnetic repulsion forces between the contact arms 66 and 308, effecting the extremely rapid separation of the contacts 72 and 306. An electrically insulating strip 309 may be used to electrically insulate the upper contact arm 308 from the lower contact arm 66.

Figures 5, 6:
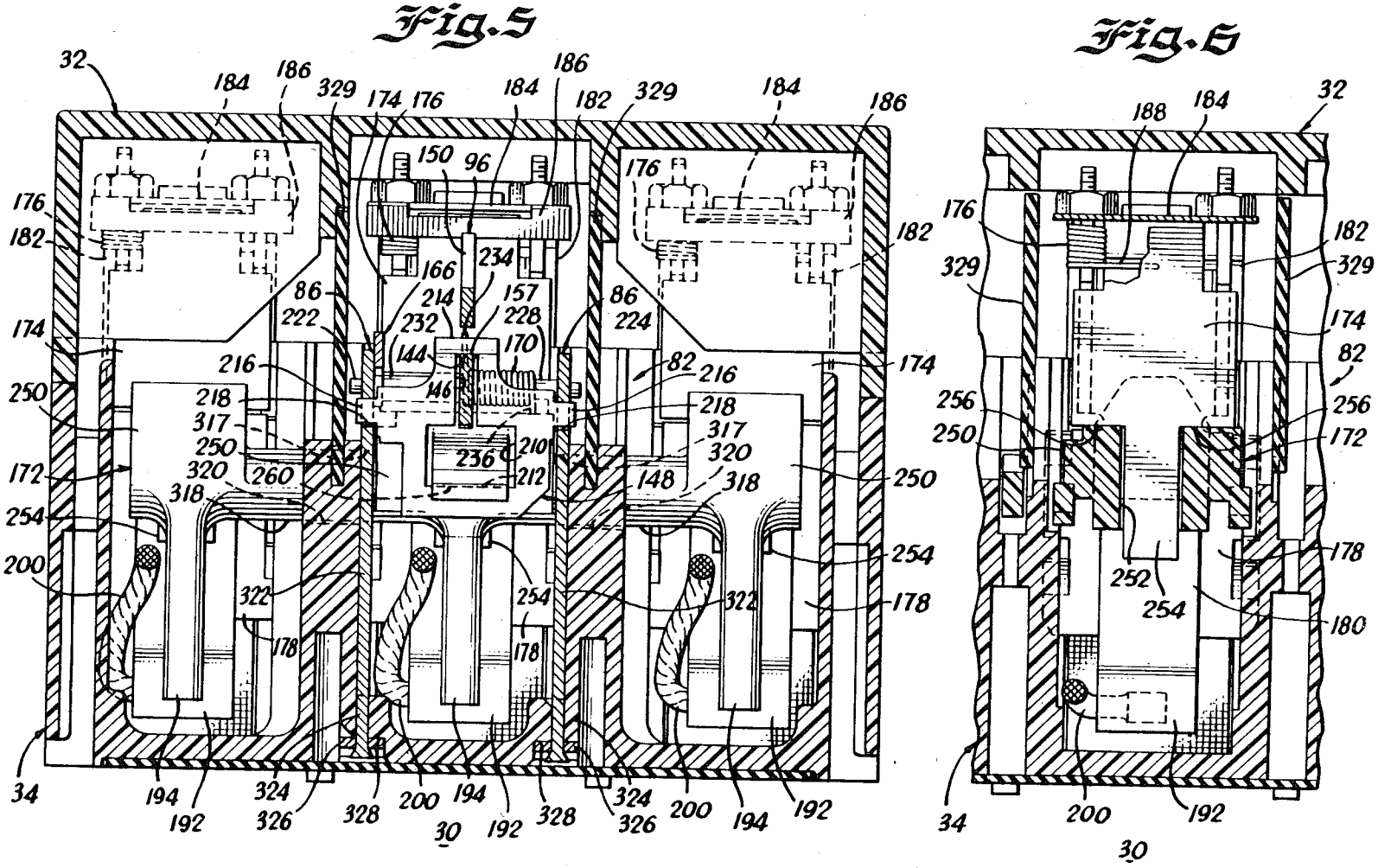
FIG. 5 is an enlarged, cross sectional view of the device of FIG. 1 taken along line 5—5 of FIG. 3.
FIG. 6 is an enlarged, fragmentary, cross sectional view of the center pole or phase of the device of FIG. 1 taken along line 6—6 of FIG. 3.
Figure 8:
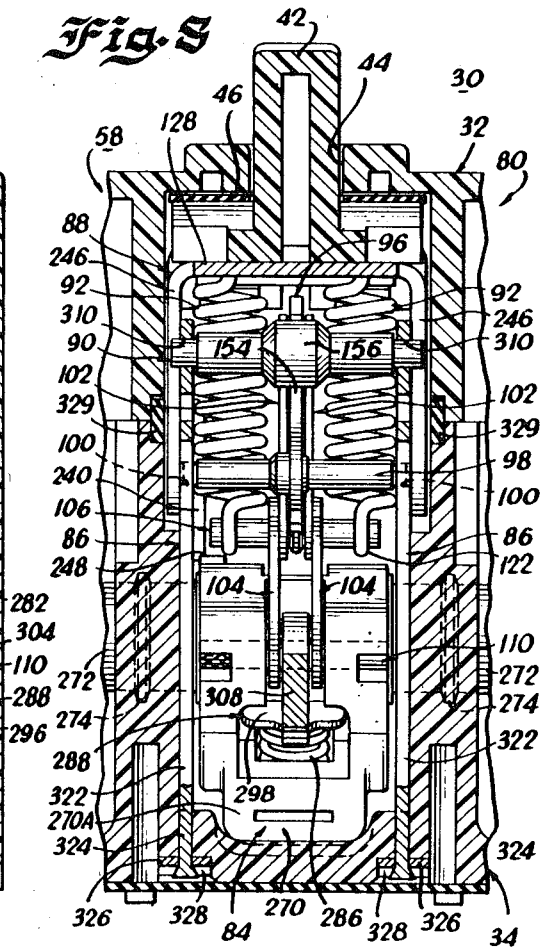
FIG. 8 is an enlarged, fragmentary, cross sectional view of the center pole or phase of the device of FIG. 1 taken along line 8—8 of FIG. 3.
Figure 7:
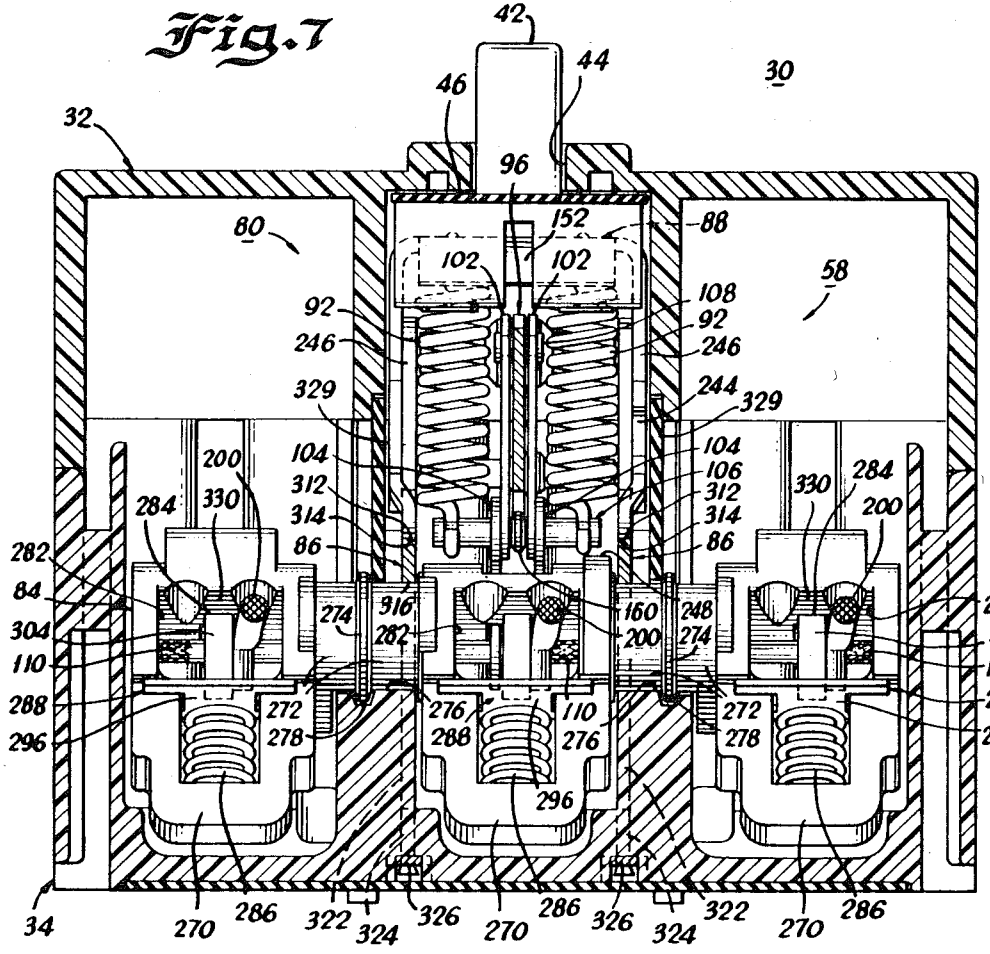
FIG. 7 is an enlarged, cross sectional view of the device of FIG. 1 taken along line 7—7 of FIG. 3.
Figure 12:
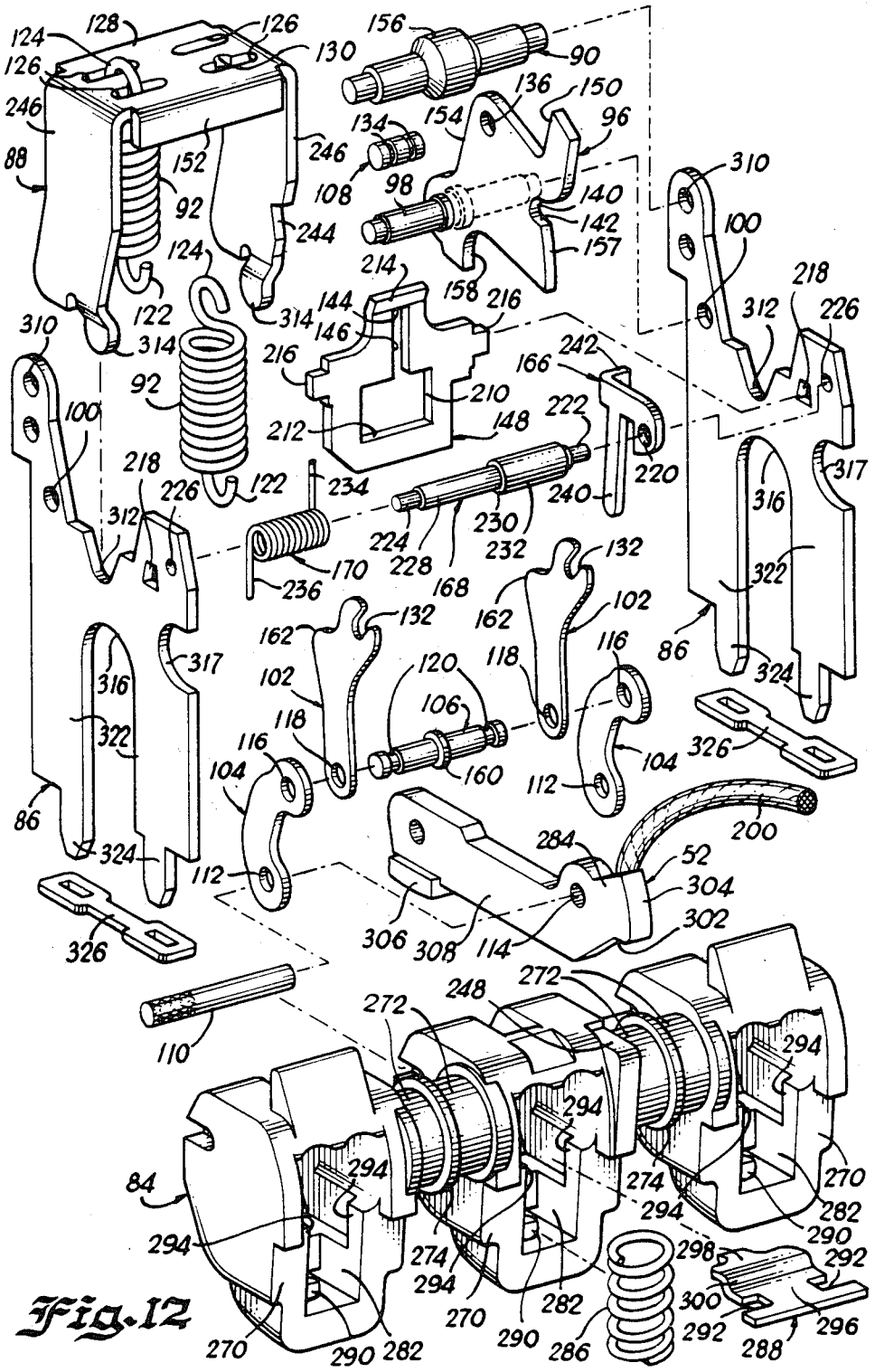
FIG. 12 is an enlarged, exploded, perspective view of portions of the operating mechanism of the device of FIG. 1.

In addition to the apertures 100, 218 and 226, the side plates 86 include apertures 310 for the receipt and retention of the opposite ends of the stop pin 90. In addition, bearing or pivot surfaces 312 are formed along the upper portion of the side plates 86 for engagement with a pair of bearing surfaces or round tabs 314 formed at the lowermost extremities of the downwardly depending support arms 246 of the handle yoke 88. The handle yoke 88 is thus controllably pivotal about the bearing surfaces 314 and 312. The side plates 86 also include bearing surfaces 316 (FIGS. 7 and 12) for contacting the upper portions of the bearing surfaces 272 of the cross bar 84 and for retaining the cross bar 84 securely in position within the base 34. The side plates 86 include generally C-shaped bearing surfaces 317 configured to engage a pair of round bearing surfaces 318 disposed between the support sections 250 of the trip bar 172 for retaining the trip bar 172 in engagement with a plurality of retaining surfaces 320 (FIG. 5) integrally formed as part of the molded base 34. Each of the side plates 86 includes a pair of downwardly depending support arms 322 that terminate in elongated, downwardly projecting stakes or tabs 324 for securely retaining the side plates 86 in the circuit breaker 30. Associated with the tabs 324 are apertured metal plates 326 that are configured to be received in recesses 328 (FIGS. 5, 7 and 8). In assembling the support plates 86 in the circuit breaker 30, the tabs 324 are passed through apertures formed through the base 34 and, after passing through the apertured metal plates 326, are positioned in the recesses 328. The tabs 324 may then be mechanically deformed, for example, by peening, to lock the tabs 324 in engagement with the apertured metal plates 326, thereby securely retaining the side plates 86 in engagement with the base 34. A pair of formed electrically insulating barriers 329 (FIGS. 5 through 8) is used to electrically insulate conductive components and surfaces in one pole or phase of the circuit breaker 30 from conductive components or surfaces in an adjacent pole or phase of the circuit breaker 30.

In operation, the circuit breaker 30 may be interconnected in a three phase electrical circuit via line and load connections to the terminals 38A, B and C and 40A, B and C. The operating mechanism 58 may be set by moving the handle 42 from its TRIPPED position (FIG. 15) as far as possible past its OPEN position (FIG. 14) to ensure the resetting of the intermediate latch plate 148, the cradle 96 and the trip bar 172 by the engagement of the latching surfaces 142 and 144 and by the engagement of the latch surfaces 212 and 258. The handle 42 may then be moved from its OPEN position (FIG. 14) to its CLOSED position (FIG. 3) causing the operating mechanism 58 to close the contacts 72 and 306; and the circuit breaker 30 is then ready for operation in protecting a three phase electrical circuit. If, due to a prior overload condition, the bimetal 180 remains heated and deflects the contact leg 194 of the trip bar 172 sufficiently to prevent the latching of the surface 212 with the surface 258, the handle 42 will return to its TRIPPED position (FIG. 15); and the electrical contacts 50 and 52 will remain separated. After the bimetal 180 has returned to its normal operating temperature, the operating mechanism 58 may be reset as described above.

Upon the occurrence of a sustained overload condition, the formed lower end 192 of the bimetal 180 deflects along a clockwise arc and eventually deflects the contact leg 194 of the trip bar 182 sufficiently to unlatch the intermediate latch plate 148 from the trip bar 172, resulting in immediate relative movement between the cradle 96 and the intermediate latch plate 148 along the inclined surfaces 142 and 144. The cradle 96 is immediately accelerated by the operating springs 92 for rotation in a counterclockwise direction (FIG. 3) resulting in the substantially instantaneous movement of the upper toggle links 102, the toggle spring pin 106 and the lower toggle links 104. As described hereinabove, the impelling surface or kicker 158 acting against the contacting surface 160 of the pin 106 rapidly accelerates the pin 106 in an upward, counterclockwise arc, resulting in a corresponding upward movement of the toggle contact pin 110 and the immediate upward movement of the upper electrical contact 52 to its TRIPPED position (FIG. 15). Since the base portions 284 of all of the upper electrical contacts 52 are biased by the springs 286 into contact with an interior surface 330 formed in each opening 282 of the cross bar 84, the upper electrical contacts 52 move in unison with the cross bar 84, resulting in the simultaneous or synchronous separation of all three of the upper electrical contacts 52 from the lower electrical contacts 50 in the circuit breaker 30. During this trip operation, any electrical arc that may have been present across the contacts 72 and 306 is extinguished.

During a trip operation, the movement of the cross bar 84 and thus of the upper electrical contacts 52 is limited by a plurlaity of three, spaced apart, integrally formed physical barriers or stops 331 (FIGS. 3, 14, 15, 16, 18, 19, 21, 22 and 25) molded in the base 34. Each stop 331 is designed to engage a leading edge or surface 270A of the three enlarged sections 270 of the cross bar 84, thereby limiting the rotational movement of the cross bar 84. Preferably, at least one stop 331 is molded in each pole or phase of a base 34 of the circuit breaker 30 for engaging the surface 270A of each enlarged section 270 associated with each pole or phase, thereby dividing the mechanical stress on the cross bar 84 at its limit position by the number of poles or phases of the circuit breaker 30. In this manner, the stop 156 in the center pole or phase of the circuit breaker 30 and the stops (not illustrated) integrally formed in the top cover 32 in the outer poles or phases of the circuit breaker 30 are merely relied on to limit the overtravel of each moving upper electrical contact 52. Since the cross bar 84 is mounted for rotation in the base 34 and since the stops 331 are molded into the base 34, the rotational movement of the cross bar 84 may be precisely determined and controlled.

During this operation, as a result of the change in the lines of action of the operating springs 92, the handle 42 is moved from its CLOSED position (FIG. 3) to its TRIPPED position (FIG. 15). As is apparent, if the handle 52 is obstructed or held in its CLOSED position (FIG. 3), the operating mechanism 58 still will respond to an overload condition or to a short circuit or fault current condition to separate the electrical contacts 50 and 52 as described hereinabove. Furthermore, if the contacts 72 and 306 become welded together, the pin 106 does not move sufficiently to change the line of action of the operating springs 92 (FIG. 3), maintaining the operating springs 92 forward (to the left) of the pivot surfaces 312 of the side plates 86 and biasing the handle 42 to its CLOSED position so as not to mislead operating personnel as to the operative condition of the electrical contacts 50 and 52.

Upon the occurrence of a short circuit or fault current condition, the magnet 178 is immediately energized to magnetically attract the armature 174 into engagement with the magnet 178, resulting in a pivotable or rotational movement of the trip leg 254 of the armature 174 in a clockwise direction (FIG. 3) against the contact leg 194 of the trip bar 172. The resultant rotational movement of the contact leg 194 in a clockwise direction release the intermediate latch plate 148 causing a trip operation as described hereinabove.

Upon the occurrence of a high level short circuit or fault current condition and as a result of the large magnetic repulsion forces generated by the flow of fault current through the generally parallel contact arms 66 and 308, the electrical contacts 50 and 52 rapidly separate and move to their BLOWN-OPEN positions (depicted in dotted line form in FIG. 3). While the compression spring 70 returns the contact arm 66 of the lower electrical contact 50 to its OPEN position (FIG. 14), the contact arm 308 is held in its BLOWN-OPEN position by the engagement of the surfaces 304 and 298 as described hereinabove. The separation of the electrical contacts 50 and 52 is achieved without the necessity of the operating mechanism 58 sequencing through a trip operation. However, the subsequent sequencing of the operating mechanism 58 through a trip operation forces the upper contact arm 308 against an electrical insulation barrier 332 and the stop 156 in the center pole or phase of the circuit breaker 30 or against stops integrally formed in the top cover 32 in the outer poles or phases of the circuit breaker 30 to cause relative rotational movement between the upper electrical contact 52 and the cross bar 84, resulting in the reengagement of the interior surface 330 of the cross bar 84 by the base portion 284 of the upper electrical contact 52 and the resultant separation of the other electrical contacts 50 and 52 in the other poles or phases of the circuit breaker 30.

In accordance with an alternative embodiment (FIG. 16–21) of the circuit breaker 30, a solenoid operator 410 is provided for moving the handle 42 from a remote location between its OFF position (FIGS. 16–18) corresponding to the OPEN position of the separable electrical contacts 50 and 52 and its ON position (FIGS. 19 and 20) corresponding to the CLOSED position of the separable electrical contacts 50 and 52. A solenoid operator cover 412 for housing the solenoid operator 410 is fixedly secured by a plurality of fasteners 413 to the top cover 32 of the circuit breaker 30. The solenoid operator 410 includes a single coil solenoid 414 formed by an electromagnet 415 having an electrical coil 416 fixedly secured to a magnetic core 418 and by a generally T-shaped armature 420 that is movable with respect to and within the electromagnet 415. The electromagnet 415 is fixedly secured to an electromagnet drive plate 422 that is disposed for rectilinear movement along the longitudinal axis of the opening 44 through the top cover 32. The armature 420 is fixedly secured to an armature drive plate 424 that is also disposed for rectilinear movement along the longitudinal axis of the opening 44. The electromagnet drive plate 422 is secured to a solenoid operator mounting plate 426 by a pair of slide bearings 428 and 430 that enable movement within a pair of elongated drive slots 432 and 434 formed in the mounting plate 426. The length of the slots 432 and 434 determines the amount of rectilinear movement of the drive plate 422 and of the electromagnet 415; and the longitudinal ends of the slots 432 and 434 establish the limit positions of the drive plate 422 and of the electromagnet 415.

Similarly, the armature drive plate 424 is secured to the mounting plate 426 by a pair of slide bearings 438 and 440 that are positioned in and movable along a pair of elongated slots 442 and 444 formed through the mounting plate 426. The length of the slots 442 and 444 determines the amount of rectilinear movement of the drive plate 424 and of the armature 420; and the longitudinal ends of the slots 442 and 444 establish the limit positions of the drive plate 424 and of the armature 420.

Figure 16:
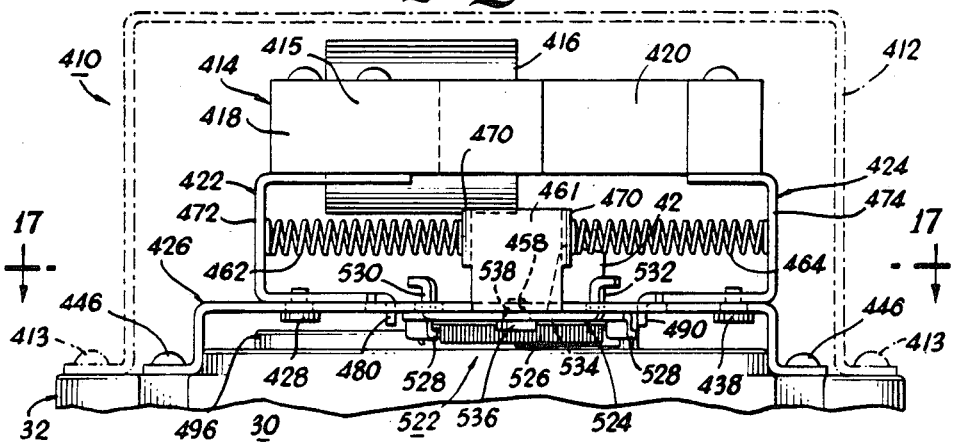
FIG. 16 is an enlarged, side elevational view of a solenoid operator for the device of FIGS. 1 through 15.
Figure 17:
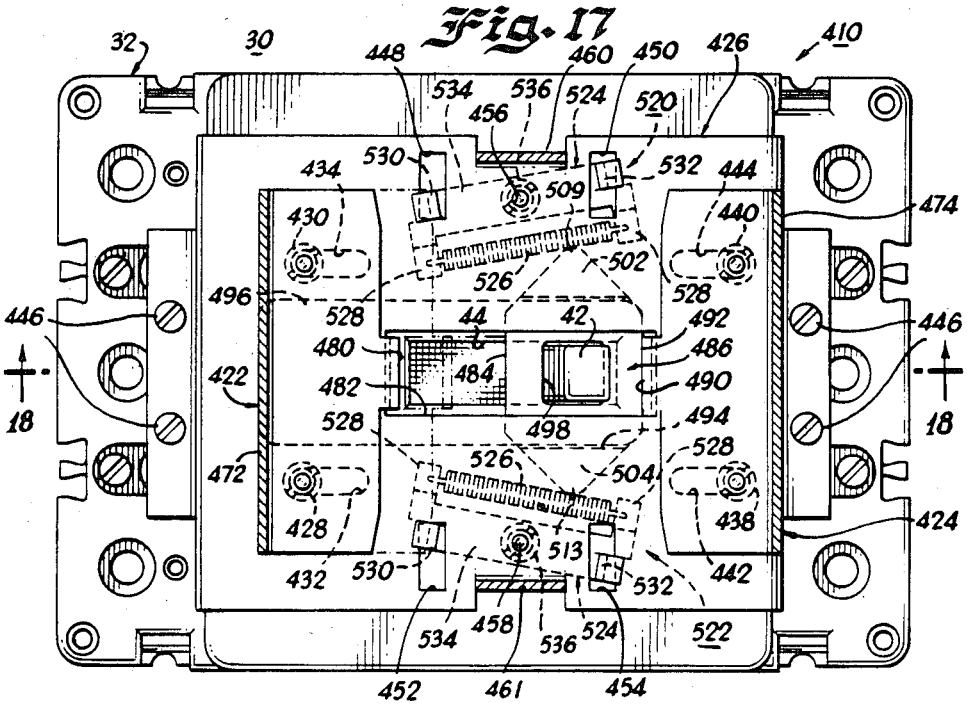
FIG. 17 is an enlarged, plan sectional view of the device of FIG. 16 taken along line 17—17 of FIG. 16, depicting the handle of the circuit breaker in its OFF position.
Figure 18:
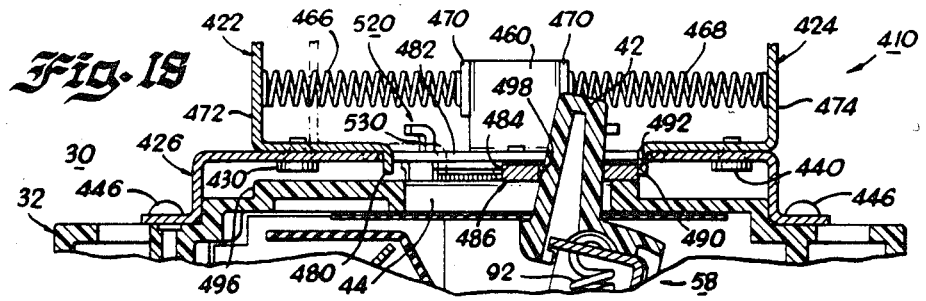
FIG. 18 is an enlarged, fragmentary, cross sectional view of the device of FIG. 16 taken along line 18—18 of FIG. 17.

The mounting plate 426, secured by a plurality of four fasteners 446 to the top cover 32, includes a plurality of four elongated latch slots 448, 450, 452 and 454 and a pair of latch pivot center apertures 456 and 458. The mounting plate 426 also includes a pair of integrally formed, spaced apart, upstanding spring brackets 460 and 461 each having a pair of integrally formed, inwardly bent rigid ears 470 for engaging the longitudinal ends of a plurality of four elongated compression springs 462, 464, 466 and 468 (FIGS. 16 and 18). The compression springs 462, 464, 466 and 468 are used to bias the drive plates 422 and 424 into their limit positions (FIGS. 16–18). The opposite longitudinal ends of the compression springs 462 and 466 are secured to an integrally formed vertically extending surface 472 of the drive plate 422; and the opposite longitudinal ends of the compression springs 464 and 468 are secured to an integrally formed vertically extending surface 474 of the drive plate 424.

The drive plate 422 includes an integrally formed, downwardly depending drive surface 480 that extends through and is disposed for movement in an elongated operating slot 482 formed through the mounting plate 426. The drive surface 480 is configured to engage a drive surface 484 of a formed trigger plate 486 disposed for rectilinear movement along the longitudinal axis of the opening 44. Similarly, the drive plate 424 includes an integrally formed, downwardly depending drive surface 490 extending through and disposed for movement in the operating slot 482 and configured to engage a drive surface 492 of the trigger plate 486.

In addition to the drive surfaces 484 and 492, the trigger plate 486 includes an elongated, generally U-shaped recessed portion or channel 494 configured to receive and move along an elongated, upwardly projecting, pedestal portion 496 of the top cover 32. The trigger plate 486 is captured between the mounting plate 426 and the pedestal portion 496 to limit its movement to rectilinear movement along the longitudinal axis of the opening 44. The trigger plate 486 also includes a centrally disposed handle receiving aperture 498 through which the handle 42 extends. In this manner, the trigger plate 486 is secured to and moves in unison with the handle 42. The trigger plate 486 also includes a pair of integrally formed, outwardly extending, tapered latch engaging portions 502 and 504. The tapered portion 502 includes a pair of converging sides 506 and 508 that meet to form a generally rounded vertical edge 509 having a relatively small radius of curvature. Similarly, the tapered portion 504 includes a pair of converging sides 510 and 512 that meet to form a generally rounded vertical edge 513 having a relatively small radius of curvature.

The solenoid operator 410 also includes a pair of pivotable, bistable mechanical spring latches 520 and 522 configured to alternately engage and stop further movement of the drive plates 422 and 424. Each of the latches 520 and 522 includes a formed latch plate 524 and an elongated tension spring 526. The longitudinal ends of each tension spring 526 are fixedly secured to integrally formed, spaced apart spring mounting portions 528.

The latch plates 524 have integrally formed, upwardly extending electromagnet drive plate stops 530 that extend through and above the latch slots 448 and 452 formed through the mounting plate 426 and that are configured to engage and stop the movement of the electromagnet drive plate 422 (dotted line portion of FIG. 17). The latch plates 524 also include integrally formed, upwardly extending armature drive plate stops 532 that extend through the latch slots 450 and 545 formed in the mounting plate 426 and that are configured to engage and stop the movement of the armature drive plate 424 (solid line portion of FIG. 19).

The stops 530 and 532 are formed at opposite longitudinal ends of an elongated planar surface 534 of the latch plate 524 that is disposed for pivotable movement beneath the mounting plate 426. The latches 520 and 522 are fixedly secured for pivotable movement to the mounting plate 426 by a plurality of pivot rivets 536 disposed in the latch pivot center apertures 456 and 458 and in an aperture 538 formed through each planar surface 534 of the latches 520 and 522. The bistable latches 520 and 522 are capable of being rapidly pivotted between two stable states or positions, an electromagnet drive plate stop state or position (FIGS. 16–18) and an armature drive plate stop state or position (FIGS. 19 and 20), by the movement of the edges 409 and 413 from one side to the other side of the pivot centers of the spring latches 520 and 522 located at the centers of the pivot rivets 536.

Prior to energization of the solenoid 414 to initiate a switching operation of the circuit breaker 30, the drive plates 422 and 424 are biased by the compression springs 462, 464, 466 and 468 to their outermost limit positions in the drive slots 432, 434, 442 and 444 (FIGS. 16–18). If the handle 42 is in its OFF position corresponding to the OPEN position of the separable electrical contacts 50 and 52 (FIGS. 16–18), the drive surface 490 of the armature drive plate 424 is in engagement with the drive surface 492 of the trigger plate 486. Upon the actuation of the solenoid 418 by an electrical pulse that energizes the electrical coil 416, the electromagnet drive plate 422 is rapidly moved into engagement with the electromagnet drive plate stops 530 of the latches 520 and 522 (dotted line portion of FIG. 17); and the armature drive plate 424 is moved along the drive slots 442 and 444 by the receipt of the armature 420 within the electromagnet 415, resulting in the movement of the trigger plate 486 along the pedestal portion 496 in unison with the handle 42.

Figure 19:
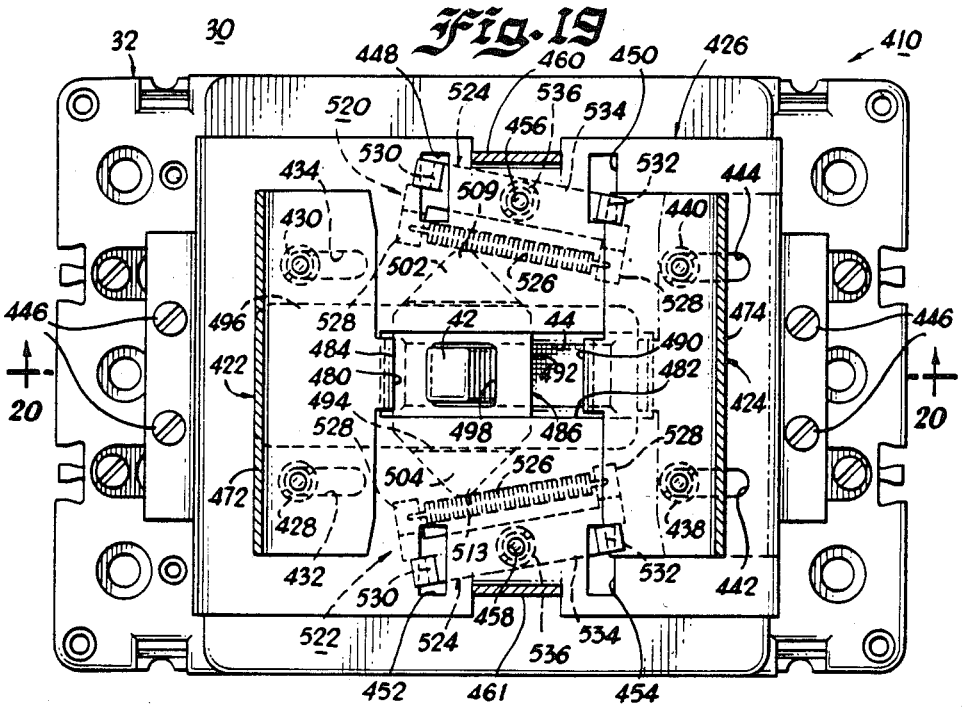
FIG. 19 is an enlarged, plan sectional view similar to the view of FIG. 17, depicting the handle of the circuit breaker in its ON position.
Figure 20:
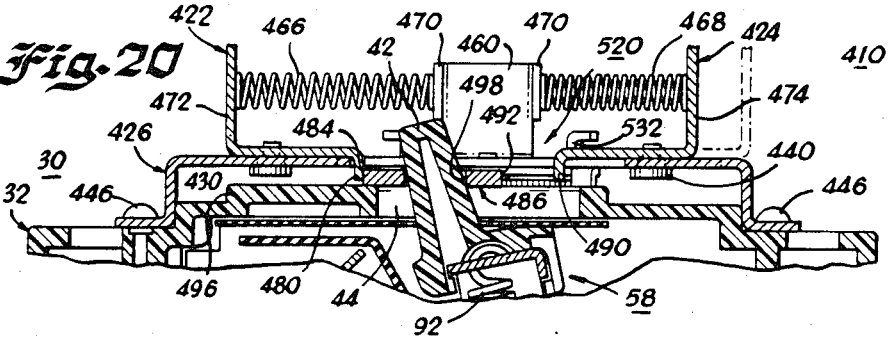
FIG. 20 is an enlarged, fragmentary, cross sectional view of the device of FIG. 16 taken along line 20—20 of FIG. 19.
Figure 21:
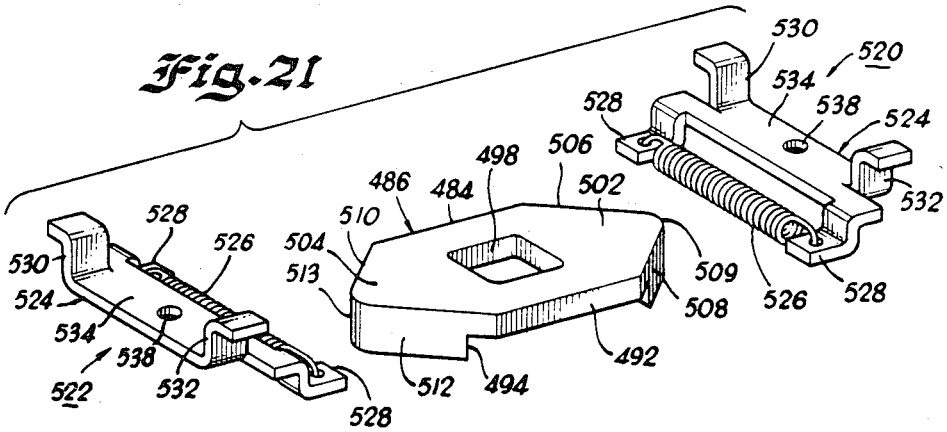
FIG. 21 is an enlarged, exploded perspective view of the trigger plate and the bistable spring latches of the device of FIG. 16.

The armature drive plate 424 continues to move the trigger plate 486 and the handle 42 along the longitudinal axis of the opening 44 until a point is reached at which the operating springs 92 change their lines of action to accelerate the handle 42 and the trigger plate 486 along the opening 44 to the ON position of the handle 42 (FIGS. 19 and 20). As the rounded edges 509 and 513 pass the pivot centers of the latches 520 and 522, the latches 520 and 522 quickly pivot about the pivot rivets 536 into their armature drive plate stop state or position, in which state the electromagnet drive plate stops 530 are shifted to the outermost portions of the latch slots 448 and 452 out of engagement with the electromagnet drive plate 422 and the armature drive plate stops 532 are shifted to the innermost portions of the latch slots 450 and 454 to stop or limit the movement of the armature drive plate 424 (solid line portion of FIG. 19). Subsequently, the armature drive plate 424 is returned to its normal, outermost limit position by the compression springs 464 and 468; and the electromagnet drive plate 422 is retained in its outermost limit position by the engagement of the drive surface 484 of the trigger plate 486 with the drive surface 480 of the electromagnet drive plate 422 or by the compression springs 462 and 466.

A subsequent energization of the same electrical coil 416 and the resultant actuation of the solenoid 414 is effective to move the handle 42 from its ON position (FIGS. 19 and 20) to its OFF position (FIGS. 16–18). Specifically, the armature drive plate 424 is moved against the bias of the compression springs 464 and 468 into contact with the armature drive plate stops 532 to limit further movement of the armature drive plate 424 in the direction of the electromagnet drive plate 422. The electromagnet drive plate 422 moves against the bias of the compression springs 462 and 466 along the drive slots 432 and 434 to drive the trigger plate 486 and the handle 42 along the longitudinal axis of the opening 44 in the direction of the armature drive plate 424. The handle 42 when moved sufficiently along the opening 44 by the trigger plate 486 causes the operating springs 92 to change their lines of action and to accelerate the handle 42 and the trigger plate 486 to the OFF position of the handle 42 (FIGS. 16–18). When the edges 509 and 513 pass the pivot centers of the latches 520 and 522, the latches 520 and 522 rapidly pivot and switch to their electromagnet drive plate stop state or position (FIGS. 16–18).

The electrical coil 416 need only be energized by an electrical pulse for a length of time sufficient to move the handle 42 to a position at which the lines of action of the operating springs 92 change. Subsequently, the operating springs 92 move the handle 42 and the trigger plate 486 to either the ON position or the OFF position of the handle 42.

As described above, rectilinear or bidirectional linear movement of the handle 42 may be achieved from a remote location by a single coil solenoid operator 410, thereby enabling the use of a simplified electrical circuit having a single switch for placing the handle 42 in its ON position or in its OFF position upon successive switch operations and resultant successive actuations of the solenoid 414. If desired, the single switch electrical control circuit depicted in FIG. 16 of the above identified commonly assigned and copending U.S. patent application Ser. No. 51,601, filed by Joseph J. Matsko, Kurt A. Grunert and Bruce R. Terhorst and entitled Solenoid Operator Circuit For Molded Case Circuit Breaker, may be used to energize the electrical coil 416 and thereby actuate the solenoid 414 and the solenoid operator 410.

Obviously, many modifications and variations of the present invention are possible in light of the above teachings. Thus, it is to be understood that, within the scope of the appended claims, the invention may be practiced otherwise than as specifically described hereinabove.

What is claimed and desired to be secured by Letters Patent is:

1. An electrical circuit breaker comprising a pair of separable electrical contacts, operating means for moving said contacts into a CLOSED position and into an OPEN position, said operating means including a manually engageable handle, and solenoid actuated means for moving said handle between an OFF position corresponding to said OPEN position of said contacts and an ON position corresponding to said CLOSED position of said contacts, said solenoid actuated means comprising a single coil solenoid, a first bistable mechanical latch having first and second stable states for alternately placing said handle in said ON position or in said OFF position upon successive actuations of said solenoid, and a second bistable mechanical latch having said first and second stable states, said first bistable mechanical latch being movable into said first state or said second state in response to the movement of said handle and including a first stop engageable with a first component of said solenoid actuated means when said first bistable mechanical latch is in said first state and being disposed out of engagement with said first component when said first bistable mechanical latch is positioned in said second state, said second bistable mechanical latch being engageable with said first component in said first state and being disposed out of engagement with said first component when positioned in said second state.

2. A solenoid operator for moving a handle of an electrical circuit breaker between an ON position and an OFF position comprising a single electrical coil solenoid, said solenoid comprising an electromagnet and an armature movable with respect to said electromagnet, a first movable plate fixedly secured to said electromagnet, a second movable plate fixedly secured to said armature, a formed member affixed to said handle for movement in unison therewith and bistable means movable between a first stable state and a second stable state for limiting the movement of said first plate in said first state and for limiting the movement of said second plate in said second state, said bistable means comprising mechanical means for contacting said formed member.

3. A solenoid operator as recited in claim 2 wherein said bistable means comprises a first rigid member pivotable alternately into said first state or into said second state, said mechanical means comprising a first elongated tension spring fixedly secured to said first rigid member, said formed member being movable along the length of said first tension spring.

4. A solenoid operator as recited in claim 3 wherein said bistable means further comprises first and second stops fixedly secured to said first rigid member, said first stop being disposed for engagement with said first plate in said first state and said second stop being disposed for engagement with said second plate in said second state.

5. A solenoid operator as recited in claim 3 wherein said bistable means further comprises a second rigid member pivotable alternately into said first state or into said second states, said mechanical means further comprising a second elongated tension spring fixedly secured to said second rigid member, said formed member being disposed for movement along the length of said second tension spring.

6. A solenoid operator as recited in claim 5 wherein said bistable means further comprises first and second spaced apart stops disposed on said first rigid member and third and fourth spaced apart stops disposed on said second rigid member, said first and third stops being disposed for engagement with said first plate in said first state and said second and fourth stops being disposed for engagement with said second plate in said second state.

7. A solenoid operator for placing a movable member alternately in a first position or in a second position comprising a single electrical coil solenoid, said solenoid comprising a movable electromagnet and a movable armature, said armature being movable within said electromagnet, first means comprising a first movable plate connecting said electromagnet to said movable member for driving said movable member, said electromagnet being fixedly secured to said first plate, second means comprising a second movable plate connecting said armature to said movable member for driving said movable member and mechanical means positionable alternately in a first stable state or in a second stable state for limiting the movement of said electromagnet in said first state and for limiting the movement of said armature in said second state, said mechanical means comprising a first pivotable, bistable mechanical latch having first and second spaced apart rigid stops fixedly secured thereto, said first stop being disposed for engagement with said first plate when said mechanical means is in said first state and said second stop being disposed for engagement with said second plate when said mechanical means is in said second state.

8. A solenoid operator as recited in claim 7 wherein the position of said mechanical means is controlled by the movement of said movable member such that said mechanical member is in said first state when said mechanical member is in said first position and said mechanical means is disposed in said second state when said movable member is in said second position.

9. A solenoid operator as recited in claim 7 wherein said mechanical means further comprises a second pivotable, bistable mechanical latch having third and fourth spaced apart stops fixedly secured thereto, said third stop being disposed for engagement with said first plate when said mechanical means is in said first state and said second stop being disposed for engagement with said second plate when said mechanical means is in said second state.

10. A solenoid operator as recited in claim 7 wherein said first latch includes an elongated tension spring fixedly secured thereto.

11. A solenoid operator as recited in claim 10 further comprising a formed member secured to said movable member for movement in unison therewith, said formed member being movable along the length of said tension spring and being in contact with said tension spring during said movement along the length of said tension spring for positioning said mechanical means in said first state or in said second state.

* * * * *